US009211556B2

(12) United States Patent
Joppen

(10) Patent No.: US 9,211,556 B2
(45) Date of Patent: Dec. 15, 2015

(54) METHOD FOR CONTROLLING THE TEMPERATURE OF A JETTING DEVICE

(71) Applicant: OCÉ-TECHNOLOGIES B.V., Venlo (NL)

(72) Inventor: Sandor Hubertus Gertrudis Joppen, Grubbenvorst (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/249,000

(22) Filed: Apr. 9, 2014

(65) Prior Publication Data

US 2014/0306023 A1 Oct. 16, 2014

(30) Foreign Application Priority Data

Apr. 16, 2013 (EP) ..... 13163892

(51) Int. Cl.

| | |
|---|---|
| ***B05B 17/04*** | (2006.01) |
| ***B05B 9/00*** | (2006.01) |
| ***B05B 13/00*** | (2006.01) |
| ***B05B 17/06*** | (2006.01) |
| ***B05B 5/025*** | (2006.01) |
| ***B41J 2/045*** | (2006.01) |
| ***B41J 2/14*** | (2006.01) |

(52) U.S. Cl.

CPC ..... *B05B 9/002* (2013.01); *B05B 5/0255* (2013.01); *B05B 13/00* (2013.01); *B05B 17/0607* (2013.01); *B05B 17/0623* (2013.01); *B41J 2/04515* (2013.01); *B41J 2/04528* (2013.01); *B41J 2/04563* (2013.01); *B41J 2/04586* (2013.01); *B41J 2/04588* (2013.01); *B41J 2/04596* (2013.01); *B41J 2/14* (2013.01); *B41J 2202/04* (2013.01)

(58) Field of Classification Search

CPC .. B05B 9/002; B05B 5/0255; B05B 17/0607; B05B 17/0623; B05B 13/00; B41J 2/04515; B41J 2/04528; B41J 2/04563; B41J 2/04586; B41J 2/04588; B41J 2/04596; B41J 2/14; B41J 2202/04

USPC ..... 239/3, 13, 128, 135, 102.1, 102.2, 690

See application file for complete search history.

(56) References Cited

U.S. PATENT DOCUMENTS

2005/0243144 A1* 11/2005 Dean et al. ..... 347/74
2015/0059684 A1* 3/2015 McAlister ..... 239/3

FOREIGN PATENT DOCUMENTS

WO WO 2010/063576 A1 6/2010
WO WO 2012/168158 A1 12/2012
WO WO 2013/050250 A1 4/2013

*Primary Examiner* — Steven J Ganey

(74) *Attorney, Agent, or Firm* — Birch, Stewart, Kolasch & Birch, LLP

(57) ABSTRACT

The invention relates to a method for operating a jetting device, configured to expel droplets of an electrically conductive fluid wherein at least a part of the conductive fluid is positioned in a magnetic field, the method comprising the steps of providing a direct electrical current in the part of the conductive fluid positioned in the magnetic field, and providing an alternating electrical current in the part of the conductive fluid positioned in the magnetic field, the alternating electrical current, wherein the direct electrical current and the alternating electrical current are controlled such that the sum of heat generated by the direct electrical current and the alternating electrical current is substantially constant.

The invention further relates to a jetting device for employing the described method.

6 Claims, 4 Drawing Sheets

METHOD FOR CONTROLLING THE TEMPERATURE OF A JETTING DEVICE

The present invention relates to a method for controlling the temperature of a jetting device and a jetting device suitable for performing such a method. In particular the present invention relates to a method for controlling the temperature of a jetting device comprising an actuation means that produces a large amount of heat when operated, the heat having a significant influence on the actual operating temperature of the jetting device. More in particular the present invention relates to a method for controlling the temperature of a jetting device which operates at elevated temperatures.

BACKGROUND OF THE INVENTION

WO 2010063576 discloses a device for jetting droplets of a fluid at a high temperature, wherein the fluid is actuated by generating a Lorentz force in the fluid, further referred to as Lorentz actuation. WO2012168158 discloses a method for controlling temperature of such device.

To be able to generate a Lorentz force the fluid must comprise an electrically-conductive fluid. The device is suited to eject droplets of fluid at a high temperature, in particular of a molten metal or a molten semi-conductor, more in particular of metals having a high melting temperature (e.g. higher than about 1200 K), such as gold, silver, copper, titanium and the like. A Lorentz force is generated in the fluid, by applying an electric current pulse through the fluid, the fluid being positioned in a magnetic field. A direction and magnitude of the resulting force is related to the cross product of the electric current and the magnetic field vector: $\vec{F}=\vec{I}\times\vec{B}$.

To expel a droplet in a predetermined direction, it is preferred that the force generated in the fluid in the predetermined direction is optimized. Therefore, to obtain a maximal force in the fluid, a direct current pulse is applied to the fluid.

The direct current pulses used to eject a droplet also heat the fluid due to the Joule effect. The heating of the fluid may eventually also heat the jetting device. The generated heat (Q [W]) is proportional to the square of the applied current (I [A]) and the total resistance (R [Ω]) of the parts of the print head through which the actuation current runs, comprising the electrode resistance, the print head material resistance, the liquid metal resistance, and contact resistances (e.g. contacts between electrodes and print head material, contact of electrodes with the liquid metal).

The generated heat per unit of time (t [s]), during which a current is applied is therefore:

$$\frac{Q}{t} = I^2 * R = \frac{V^2}{R} \qquad \text{formula 1}$$

For the purpose of jetting droplets according to the above described method, the applied current may be very high (i.e. in the order of 100 A-200 A). If the electrically conductive fluid is ejected at a low frequency, (e.g. ~1-10 Hz) and short pulse widths (e.g. <50 μs) the Joule effect may be small. However, to optimize productivity of printing systems for jetting droplets of an electrically conductive fluid, it is desired that the fluid is jetted at high frequencies (e.g. about 5 kHz or even higher). It is observed that at such high frequencies the average temperature of the jetting device, in particular of the nozzle can get very high. As long as the jetting device is made of suitable material capable of withstanding high temperatures, this does not have to be a problem.

However, the heat generated by the jetting device may not be constant over time. E.g. in between two subsequent direct current pulses, or in between print jobs, no direct current pulses may be applied to the electrically conductive fluid and hence, no Joule effect may occur to heat the fluid. Consequently, there may be substantial differences in the temperature of the jetting device and the electrically conductive fluid over time. Differences in temperature may cause fluctuations in jetting performances over time. This situation is undesired because it affects the jetting process, because the properties of molten metals and semi-conductors are temperature dependent.

Therefore a need exists for a method for adequately controlling the temperature of a jetting device for jetting droplets of an electrically conductive fluid at a high temperature. It is a further object of the invention to control the temperature of such jetting device without decreasing productivity.

It is therefore an object of the present invention to provide such a method.

It is another object of the present invention to provide a jetting device suitable for performing such a method.

SUMMARY OF THE INVENTION

The above object is achieved in a method for operating a jetting device, the jetting device being configured to expel droplets of an electrically conducting fluid wherein at least a part of the conductive fluid is positioned in a magnetic field, the method comprising the steps of:

a) providing a direct electrical current in the part of the conductive fluid positioned in the magnetic field, thereby generating a Lorentz force in the conductive fluid and generating an amount of heat, and;
b) providing an alternating electrical current in the part of the conductive fluid positioned in the magnetic field, the alternating electrical current generating an amount of heat;
c) controlling the direct electrical current and the alternating electrical current such that the sum of heat generated by the direct electrical current and the alternating electrical current is substantially constant.

In a known system for printing an electrically conductive fluid, a droplet of said electrically conductive fluid is expelled through an orifice by a Lorentz force. This force causes a motion in the conductive fluid. This motion may cause a part of the fluid to move from the fluid chamber through the orifice, thereby generating a droplet of the fluid. The Lorentz force is related to the electric current and the magnetic field vector; $\vec{F}=\vec{I}\times\vec{B}$. The Lorentz force resulting from the direct electric current and the magnetic field is generated in a direction perpendicular to both the electrical current and the magnetic field. By suitably selecting the direction and the magnitude of the electric current, as well as the direction and the magnitude of the magnetic field, the direction and the magnitude of the resulting Lorentz force may be selected. In the system according to the present invention, in normal operation, the magnetic field is provided and a direct electrical current is provided in the conductive fluid, such that a suitable force for ejecting a droplet is generated. Thus, in the context of the present invention, the direct current pulse may be configured to actuate the electrically conductive fluid, thereby generating a droplet of said fluid. The direct current pulse is also referred to as actuation pulse.

The jetting device in accordance with the present invention comprises a fluid chamber and has an orifice extending from the fluid chamber to an outer surface of the fluid chamber element. In operation, the fluid chamber comprises an electrically conductive fluid. The electrically conductive fluid may be a molten metal or a molten semiconductor. In addition, the fluid may be a mixture of molten metals, a mixture of molten semiconductors or a mixture of at least one molten metal and at least one molten semiconductor. For example, droplets of molten silver, molten gold, molten copper or molten solder may be jetted using the jetting device in accordance with the present invention. The electrically conductive fluids may be essentially free of solvents; thus, the metal or semiconductor does not need to be dissolved, but may be jetted in its essentially pure (molten) form. If the fluid is essentially free of solvents, no changes in composition of the fluid may occur due to evaporation of the solvent. As a consequence, the composition of the fluid in the fluid chamber, as well as its properties, may not change with time.

During Lorentz actuation using a direct current, in addition to generation a motion in the electrically conductive fluid, also heat is generated. The amount of generated by the actuation current of the actuation current per unit of time is:

$$\frac{Q}{t} = I_{direct}^2 * R = \frac{V^2}{R} \qquad \text{formula 1}$$

The amount of heat generated within the electrically conductive fluid, which in operation conducts the (direct) actuation current, may dissipate towards different parts of the jetting device, such as the electrodes, the magnet or the walls of the chamber holding the electrically conductive fluid. The heat dissipation may therefore result in a temperature rise of the parts of the jetting device. The corresponding change in temperature may influence the jetting behaviour of the jetting device. For example, the properties of the electrically conductive fluid, such as viscosity, density and surface tension, may change with temperature. When properties of the electrically conductive fluid change, the behaviour of the fluid upon actuation may change, thereby changing the jetting behaviour. Furthermore, heat generated in the electrically conductive fluid may dissipate towards other parts of the jetting device, such as a magnet generating the magnetic field. The magnetic field generated by the magnet may also be temperature dependent. Changes in the magnetic field may also results in changes in the jetting behaviour. In summary, changes in temperature may result in changes of the jetting behaviour.

Especially the temperature close to the orifice as well as the temperature close to the part of the jetting device, where the direct current is applied to the electrically conductive fluid, are important. Hence, especially in those places, the temperature has to be substantially constant.

The direct current may be generated by a suitable direct current source. Examples of such direct current sources are batteries, solar cells and dynamos. The direct current may be provided to the electrically conductive fluid via suitable electrodes, referred to as the actuation electrodes.

Heat may also be generated in the electrically conductive fluid by providing an alternating current to the fluid. The magnitude of the alternating current changes with time according to a sinusoidal curve. The amplitude of the sinusoidal curve is the maximum current ($I_{max}$). Furthermore, the alternating current has a root mean square current ($I_{RMS}$). The average heat generated by the alternating current per unit of time equals:

$$\frac{\overline{Q}}{t} = (I_{RMS})^2 * R = \frac{(V_{RMS})^2}{R} \qquad \text{Formula 2}$$

Thus, by providing an alternating electrical current in the part of the conductive fluid positioned in the magnetic field, the alternating electrical current may generate an amount of heat.

The magnitude and direction of the alternating current constantly changes. If the alternating current is applied to a part of the electrically conductive fluid present in the magnetic field, then a Lorentz force may be generated in the electrically conductive fluid by the alternating current. Thus, some movement may be generated in the electrically conductive fluid by the alternating current. However, because the magnitude and direction of the alternating current constantly changes, inertia may prevent that the movement generated by the alternating current results in ejection of a droplet. It is preferred that the frequency and the amplitude of the alternating current is selected such that no droplet is ejected because of the alternating current applied to the fluid. The optimal frequency and amplitude of the alternating current may depend on the properties of the system, such as the properties of the electrically conductive fluid, e.g. the viscosity and properties of the jetting device, such as acoustic characteristics of the fluid chamber. In the context of the present invention, the alternating current may be configured not to actuate the electrically conductive fluid, thereby not generating a droplet of said fluid.

The alternating current may be generated by a suitable alternating current source. Any suitable type of alternating current source may be used, such as a current amplifier, e.g. a high current amplifier or high power amplifier. Optionally, the frequency and/or the amplitude of the alternating current may be changed. For example, the frequency of the alternating current may be changed using a voltage controlled oscillator. The amplitude may be changed by an amplifier, for example. The alternating current may be provided to the electrically conductive fluid via suitable electrodes. Preferably, the alternating current may be provided to the electrically conductive fluid via the actuation electrodes, which may also be used to apply the direct current.

Furthermore, the method according to the present invention comprises the step of:

controlling the direct electrical current and the alternating electrical current such that the sum of heat generated by the direct electrical current and the alternating electrical current is substantially constant.

As stated above, heat may be generated by applying a current to the electrically conductive fluid. Both a direct current and an alternating current may generate heat in the electrically conductive fluid, see formula 1 and formula 2, respectively. The heat generated in the electrically conductive fluid may (partially) dissipate towards the jetting device, thereby heating the jetting device. Heating up of the jetting device may result in change in jetting properties. By suitably controlling both the direct electrical current and the alternating electrical current, the heat generated by the alternating current as well as the heat generated by the direct current may be suitably controlled. Thereby, the sum of heat generated by the direct electrical current and the alternating electrical current may be kept substantially constant.

The direct electrical current and the alternating electrical current may be applied simultaneously or alternatively.

In an embodiment, both the direct electrical current and the alternating electrical current are provided to the electrically conductive fluid via the actuation electrodes. By applying alternating and direct current to the fluid via the same means, the alternating and direct current are provided to the fluid at the same location. This may prevent local temperature differences and hence may provide efficient temperature control.

In a further embodiment, the actuation means are positioned in proximity of the orifice. Positioning the actuation means in proximity of the orifice may provide efficient actuation of the fluid. Furthermore, by applying the direct and the alternating current in proximity of the orifice, heat may be suitably generated in proximity of the orifice and the temperature of the orifice can be suitably controlled. Keeping the temperature of the orifice at a constant high temperature may prevent instability of the jetting process. In it also believed that keeping the orifice at a constant and high temperature may prevent clogging of the nozzle.

Optionally, the jetting device may comprise further heating elements. For example, the jetting device may be provided with an induction coil. The induction coil may be provided at some distance from the orifice; i.e. the induction coil does not necessarily have to be (but may) be arranged at a part of the jetting device not comprising the orifice. The induction coil may be useful, e.g. when starting up the jetting device, for example by heating the material in the jetting device to a temperature above its melting point, thereby providing the jetting device with the electrically conductive fluid.

In an embodiment, the induction coil may also be operatively connected to the control unit. In that way, inductive heating may be efficiently controlled.

In an embodiment, the alternating electrical current is a high frequency alternating current. The frequency of the alternating current may be in the range of from 100 kHz to 1000 kHz. Preferably, the frequency of the alternating current may be in the range of from 250 kHz to 800 kHz. An alternating current having a high frequency, for example a frequency in the range mentioned above, is a current having a sinusoidal curve, wherein the time in between two adjacent maxima is short. Because the high frequency alternating current quickly changes sign, the direction of the Lorentz force generated by the alternating current quickly changes.

If the direction of the Lorentz force generated would change slowly then the application of the alternating current might result in movement of the fluid leading to the ejection of a droplet. This may be undesired, because the alternating current may be configured not to actuate the electrically conductive fluid, thereby not generating a droplet of said fluid. However, due to inertia, it may take some time for the direction of the (net) movement of the fluid, induced by the Lorentz force, to change. Therefore, the faster the direction of the Lorentz force generated changes, the less likely that the alternating current will result in significant movement of the fluid within the pressure chamber. This may be beneficial for jetting stability. Furthermore, applying an alternating electrical current to the electrically conductive fluid does not need to result in the ejection of a droplet.

In an embodiment, the jetting device is configured to, in step a) provide a first pulse of the direct electrical current, thereby ejecting a first droplet of the electrically conductive fluid and providing a second pulse of the direct electrical current, thereby ejecting a second droplet of the electrically conductive fluid, wherein the magnitude of the current of the first pulse and the second pulse is equal;

b) in between the first and second pulse of direct electrical current, provide an alternating electrical current in the part of the conductive fluid positioned in the magnetic field.

When operating the jetting device, droplets of the electrically conductive fluid may be ejected from an orifice. The droplets are ejected due to a movement in the fluid, which results from the generation of a suitable Lorentz force in the fluid. This Lorentz force is generated by applying a direct current to a part of the electrically conductive fluid positioned in the magnetic field. The direct current may be applied in the form of pulses. The pulse may have a starting point and an end point. In operation, the jetting device may eject a plurality of droplets. Each droplet may result from a single direct current pulse. Thus, a plurality of direct current pulses, each current pulse generating an amount of heat in addition to the Lorentz force, may be applied to eject the plurality of droplets. The pulses may have a certain duration, which is known as the pulse width. By altering the pulse width, the characteristics of the droplet generated, such as the volume of the droplet, may be influenced. For example, the longer the pulse width, the larger is the volume of the droplet generated. There may be a certain interval between two subsequent direct current pulses. By terminating a first direct current pulse, a first droplet may be formed and ejected through the orifice. In order to form defined droplets, it may be necessary to have a pause in the series of direct current pulses. In between two subsequent direct current pulses, e.g. in between a first and second direct current pulse, no heat may be generated by the direct current. This may result in a temporary cool down of the fluid and the jetting device. Moreover, if the time intervals during the direct current pulses are irregular, temperature fluctuations in the jetting device and in the fluid may occur.

The amount of heat generated by the pulse of direct current depends e.g. on the magnitude of the current applied and on the duration of the pulse. In this embodiment, the magnitude of the current of the first pulse and the second pulse may be equal. Consequently, the amount of heat generated per unit of time is the same for the two pulses of direct current.

In the embodiment, in between the first and second pulses, no direct current may be applied to the electrically conductive fluid present in the jetting device. Therefore, no heat may be generated by direct current. To keep the temperature of the jetting device and the fluid inside constant, in between the first and second direct current pulse an alternating current is applied, wherein the alternating current is controlled such that the amount of heat generated by the alternating current equals the amount of heat generated by the direct current pulse during the first or second pulse. Thus, the amount of heat generated in the system is constant. Hence, the temperature of the jetting device as well as the fluid inside may be substantially constant.

In an aspect of the invention, a jetting device for printing a droplet of an electrically conductive fluid is provided, the jetting device comprising:

a fluid chamber for holding an amount of the electrically conductive fluid; and an actuation assembly configured to expel droplets of the electrically conductive fluid from the chamber through a nozzle, the actuation assembly comprising a magnetic field generating unit for generating a magnetic field in at least a part of the fluid chamber; and an electrical direct current generating unit for generating a direct electrical current in the electrically conductive fluid in the part of the chamber provided with the magnetic field, thereby generating a pressure wave in the conductive fluid in said part of the fluid chamber, wherein the jetting device further comprises :

an electrical alternating current generating unit for generating a alternating electrical current in the electrically conductive fluid in the part of the chamber provided with the magnetic field, control means configured to in operation control the direct electrical current and the alternating electrical current such that the sum of heat generated by the direct electrical current and the alternating electrical current is substantially constant.

The printing device according to the present invention is thus configured for performing the method according to the present invention.

In an embodiment, the electrical direct current generating unit is operatively connectable to two electrodes in contact with the electrically conductive fluid for providing the electrical direct actuation current in the conductive fluid, the printing device being configured such that the two electrodes are operatively connected to the electrical direct current generating unit upon actuation.

The two electrodes may both be operatively connected to electrically conductive fluid and may thereby apply the direct electrical current provided by the electrical direct current generating unit to the electrically conductive fluid.

In an embodiment, the electrical alternating current generating unit is operatively connectable to the two electrodes in contact with the electrically conductive fluid. In this embodiment, the two electrodes may be used to apply both the direct current provided by the electrical direct current generating unit as well as the alternating current provided by the electrical alternating current generating unit to the electrically conductive fluid. The heat dissipated in a system depends e.g. on the total resistance of the several parts of the system through which a current runs, e.g. the electrode resistance, the print head material resistance, the liquid metal resistance, and contact resistances. In case the resistance of the connection between the electrical alternating current generating unit and the two electrodes is similar, preferable equal, to the resistance of the connection between the electrical direct current generating unit and the two electrodes, then the control unit may control the direct electrical current and the alternating electrical current such that the sum of $I_{direct}$ and $I_{RMS}$ is substantially constant.

BRIEF DESCRIPTION OF THE DRAWINGS

These and further features and advantages of the present invention are explained hereinafter with reference to the accompanying drawings showing non-limiting embodiments and wherein.

In the drawings, same reference numerals refer to same elements.

DETAILED DESCRIPTION OF THE DRAWINGS

Figure 1:
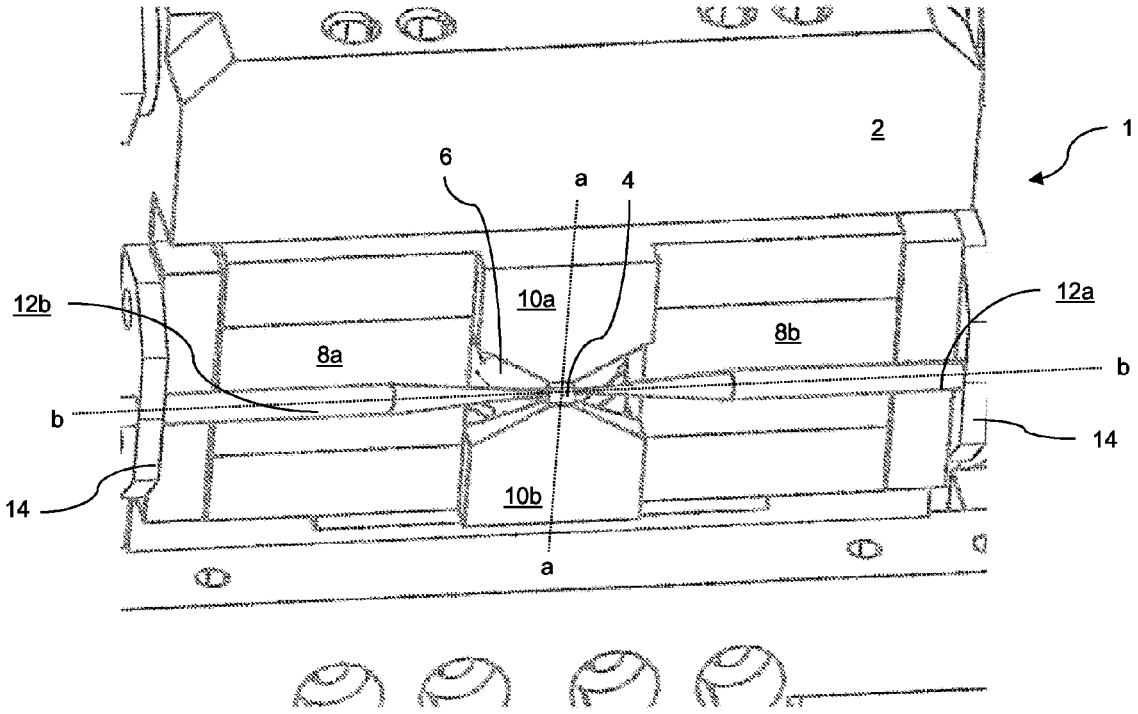
FIG. 1 shows a perspective view of a printing device for printing droplets of an electrically conductive fluid.

FIG. 1 shows a part of a jetting device 1 for ejecting droplets of a relatively hot fluid, in particular a molten metal such as copper, silver, gold and the like. The jetting device 1 comprises a support frame 2, made of a heat resistant and preferably heat conductive material.

The jetting device 1 is provided with an ejection nozzle 4 through which a droplet of the fluid may be ejected. The nozzle or orifice 4 is a through hole extending through a wall of a fluid chamber body 6. In the fluid chamber body 6 a fluid chamber is arranged. The fluid chamber is configured to hold the fluid.

For ejecting droplets of molten metal, the jetting device 1 is provided with two permanent magnets 8*a*, 8*b* (hereinafter also referred to as magnets 8). The magnets 8 are arranged between two magnetic field concentrating elements 10*a*, 10*b* (hereinafter also referred to as concentrators 10) made of magnetic field guiding material such as iron. The jetting device 1 is further provided with two electrodes 12*a*, 12*b* (hereinafter also referred to as electrodes 12) both extending into the fluid chamber body 6 through a suitable through hole such that at least a tip of each of the electrodes 12 is in direct electrical contact with the molten metal present in the fluid chamber. The electrodes 12 are supported by suitable electrode supports 14 and are each operatively connectable to suitable electrical current generators (not shown) such that a suitable electrical current may be generated through the electrodes 12 and the molten metal present between the tips of the electrodes 12.

Figure 2:
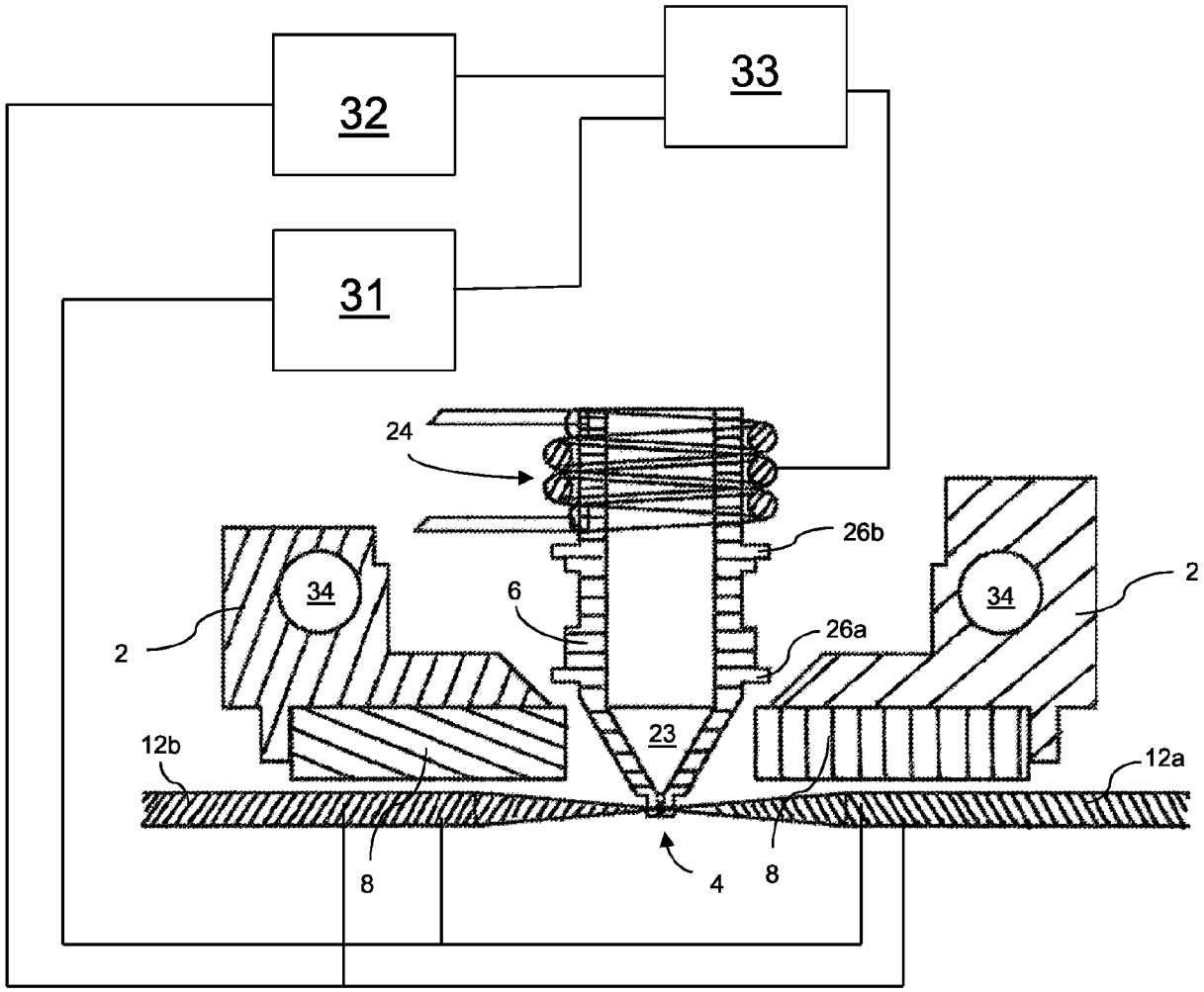
FIG. 2 shows a cross-sectional view of a part of the printing device shown in FIG. 1.

FIG. 2 shows a cross-section of the embodiment illustrated in FIG. 1, which cross-section is taken along line b-b (FIG. 1). Referring to FIG. 2, the support frame 2 and the magnets 8 are shown. In the illustrated embodiment, the support frame 2 is provided with cooling channels 34 through which a cooling liquid may flow for actively cooling of the support frame 2 and the magnets 8. An induction coil 24 is shown. The fluid chamber body 6 is arranged in a center of the induction coil 24 such that a current flowing through the induction coil 24 results in heating of a metal arranged in the fluid chamber 6. Due to such heating the metal may melt and thus become a fluid. Such inductive heating ensures a power-efficient heating and no contact between any heating element and the fluid, limiting a number of (possible) interactions between elements of the jetting device 1 and the fluid. Nevertheless, in other embodiments, other means for heating the metal in the fluid chamber may be applied. The presence of the induction coil may help in controlling the temperature of the fluid in a position away from the orifice 4. Also, it may be useful to heat the fluid using the induction coil 24, for example at start up of the jetting device, when the electrically conductive material is molten to become an electrically conductive fluid.

The jetting device 1 further comprises a control unit 33. The control unit 33 is operatively connected to the electrical alternating current generating unit 31 and the electrical direct current generating unit 32. Non-limiting examples of suitable electrical direct current generating units are batteries, solar cells and dynamos. Non-limiting examples of suitable electrical alternating current generating units are high power amplifiers or high current amplifiers. In the embodiment shown in FIG. 2, both the electrical alternating current generating unit 31 and the electrical direct current generating unit 32 are connected to electrodes 12. Thus, the direct electrical current generated by the electrical direct current generating unit 32 can be applied to the fluid present in the actuation chamber 23 through the electrodes 12. The amount of direct electrical current supplied to the fluid via the electrodes as well as the amount of alternating electrical current supplied to the fluid may be controlled by control unit 33. The control unit 33 may control the direct electrical current and the alternating electrical current such that the sum of heat generated by the direct electrical current ($I_{direct}^2$*R) and the alternating electrical current (($I_{RMS}$)$^2$*R) is substantially constant.

In the embodiment shown in FIG. 2, the control unit 33 is also operatively connected to the induction coil 24. The induction coil 24 is positioned further away from the orifice than the electrodes 12. Heating of the fluid in the fluid chamber 6 using the induction coil 24 may have less influence on the temperature of the orifice 4 as heating the fluid in the actuation chamber 23 using the electrodes. However, the induction coil 24 may assist in keeping the fluid as well as the fluid chamber body 6 around a desired temperature and keeping the fluid molten.

Figure 3A:
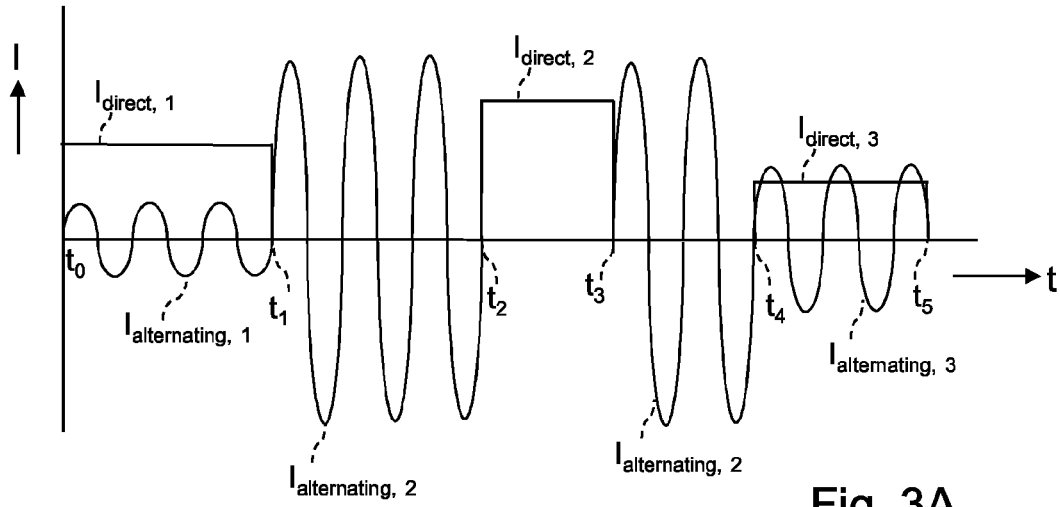
FIG. 3A and FIG. 3B schematically show a first example of the method according to the present invention.
Figure 3B:
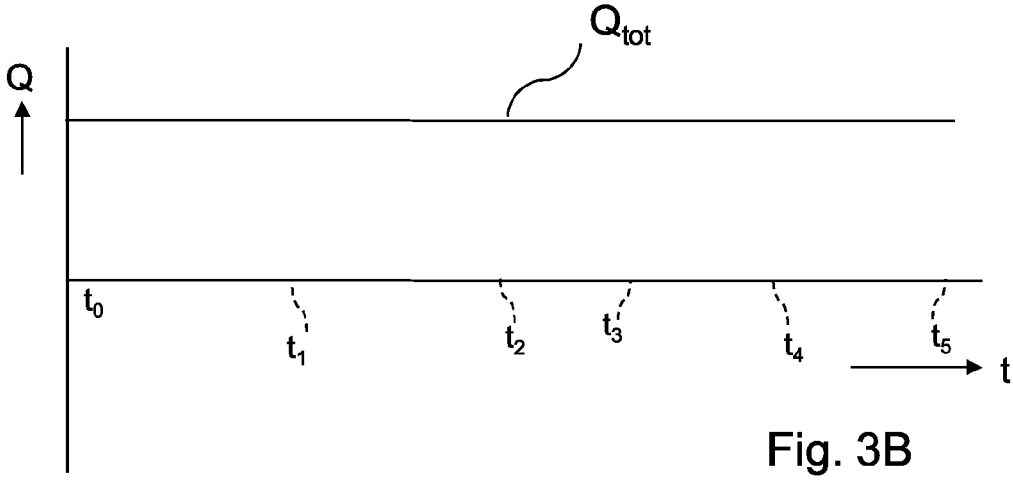

FIG. 3A shows a first example of the method according to the present invention. FIG. 3B shows the corresponding (total) amount of heat generated in the electrically conductive fluid by the alternating and direct electrical current.

At the start at $t_0$, a direct electrical current ($I_{direct,\ 1}$) is applied to the fluid. The electrical current is applied to the fluid until $t_1$. Thus, in between $t_0$ and $t_1$ a direct current pulse is applied to the fluid. Please note that, although the direct pulses as shown in FIG. 3A are rectangular, other shaped pulses may also be applied, for example pulses having a trapezoid shape. The direct current which is applied to the fluid generates a certain amount of heat in the fluid. At the same time, an alternating current $I_{alternating,\ 1}$ is applied to the fluid. Due to both the alternating current and the direct current heat is generated in the electrically conductive fluid. In FIG. 3B, it is shown that during application of the direct current $I_{direct,\ 1}$ and $I_{alternating,\ 1}$ the total amount of heat generated equals $Q_{tot}$.

At $t_1$, no more direct current is applied. To produce a constant amount of heat by the electrical current, the alternating current is switched from $I_{alternating,\ 1}$ to $I_{alternating,\ 2}$. $I_{alternating,\ 2}$ is larger than $I_{alternating,\ 1}$. $I_{alternating,\ 2}$ is applied from $t_1$ to $t_2$. As is shown in FIG. 3B, the amount of heat generated by $I_{alternating,\ 2}$ is $Q_{tot}$, which is equal to the amount of heat produced in the fluid by $I_{direct}$ and $I_{alternating,\ 1}$ together. Thus, even though no direct current is applied in between $t_1$ and $t_2$, the amount of heat generated in the system does not change and the temperature of the fluid and the jetting device may be kept constant. At $t_2$, a direct current $I_{direct,\ 2}$ is applied. This direct current pulse is stopped at $t_3$. In between $t_2$ and $t_3$, the $I_{direct,\ 2}$, which is higher than $I_{direct,\ 1}$ is applied. No alternating current is applied. However, as is shown in FIG. 3B, the total amount of heat generated in the system in between $t_2$ and $t_3$ still equals $Q_{tot}$.

At $t_3$, the direct current pulse having a value $I_{direct,\ 2}$ is stopped and an alternating current $I_{alternating,\ 2}$ is applied. This alternating current ensures that the amount of heat produced in the system is kept constant, as is shown in FIG. 3B. At $t_4$, the alternating current $I_{alternating,\ 2}$ is stopped. In addition, at $t_4$, a new direct current pulse $I_{direct,\ 3}$ is applied as well as an alternating current $I_{alternating,\ 3}$. Both $I_{direct,\ 3}$ and $I_{alternating,\ 3}$ continue until $t_5$. As shown in FIG. 3B, in between $t_4$ and $t_5$, the total amount of heat generated in the system in between $t_2$ and $t_5$ still equals $Q_{tot}$.

Thus, even though in between $t_0$ and $t_5$ different current pulses have been applied, the direct electrical current and the alternating current have been controlled such that the total amount of heat generated was constant throughout the entire time interval $t_0$-$t_5$.

Figure 4A:
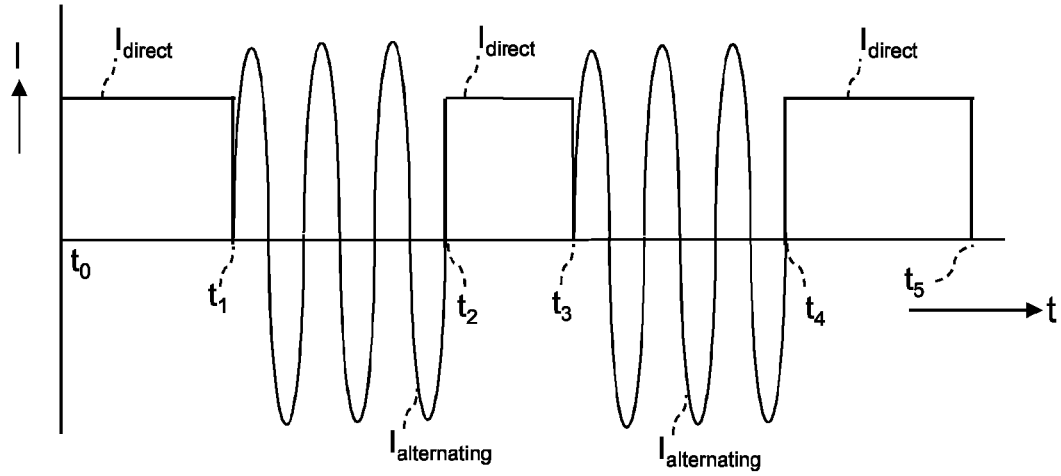
FIG. 4A and FIG. 4B schematically show a second example of the method according to the present invention.
Figure 4B:
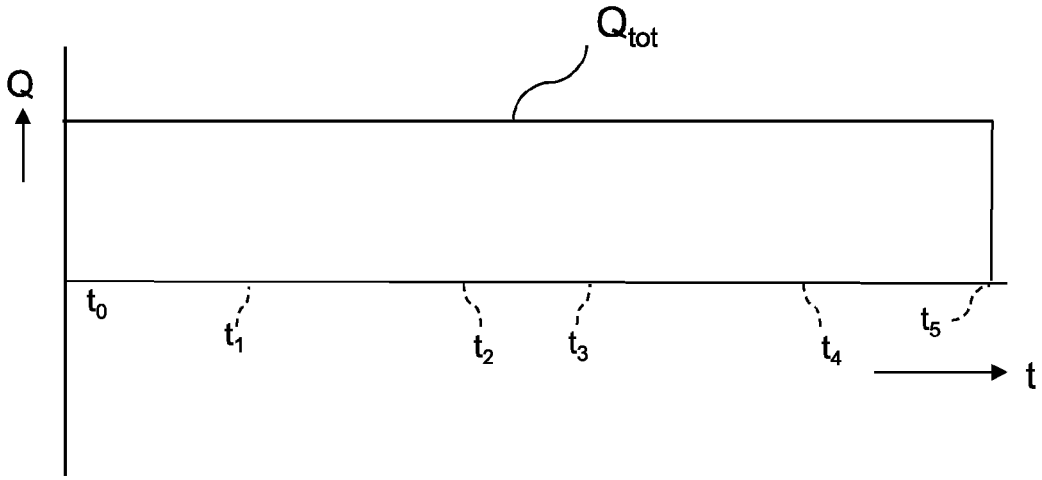

FIG. 4A shows a second example of the method according to the present invention. FIG. 4B shows the corresponding (total) amount of heat generated in the electrically conductive fluid by the alternating and direct electrical current.

In the second example, a plurality of direct current pulses ($I_{direct}$) is applied to the electrically conductive fluid. The magnitude of the current applied during each of the direct current pulses ($I_{direct}$) is equal. Such sequence of direct current pulses may be used for example to print a series of droplets. In case the pulse width of the direct current pulse is constant, then each of the droplets of the series of droplet may have the same volume. However, the widths of the pulse may also vary along the different pulses of direct current applied.

In between $t_0$ and $t_1$, a first direct current pulse is applied, having a magnitude of $I_{direct}$. As a result of this current, an amount of heat Q that equals $Q_{tot}$ is generated in the electrically conductive fluid as is shown in FIG. 4B. At $t_1$, the first direct current pulse stops and an alternating current $I_{alternating}$ is applied. The alternating current is applied until $t_2$. The magnitude of the alternating current is selected such that the amount of heat generated by the alternating current (($I_{RMS}$)$^2$*R) equals the amount of heat generated by the pulse of direct current ($I_{direct}^2$*R). As is shown in FIG. 4B, the amount of heat Q generated in the fluid does not change when the direct current $I_{direct}$ is replaced by the alternating current $I_{alternating}$ and constantly equals $Q_{tot}$. At $t_2$, the alternating current $I_{alternating}$ is stopped and a direct current pulse is applied again. The magnitude of the current applied in this second direct current pulse equals the magnitude of the current applied in the first direct current pulse. As a consequence, as is shown in FIG. 4B, in between $t_2$ and $t_3$, the amount of heat Q generated in the system equals $Q_{tot}$, which is equal to the amount of heat generated during the first direct current pulse in between $t_0$ and $t_1$ and during the alternating current, which was applied in between $t_1$ and $t_2$. At $t_3$, the second direct current pulse is stopped and an alternating current is applied. The amplitude of the alternating current $I_{alternating}$ applied in between $t_3$ and $t_4$ equals the amplitude of the alternating current $I_{alternating}$ applied in between $t_1$ and $t_2$. Therefore, as is shown in FIG. 4B, the total amount of heat Q generated in the fluid does not change at $t_3$. At $t_4$, the alternating current is stopped and a third direct current pulse is applied, the magnitude of the direct current $I_{direct}$ being equal to the magnitude of the direct current pulses applied in between $t_0$ and $t_1$ and in between $t_2$ and $t_3$, respectively. As a consequence, the amount of heat Q generated in the fluid does not change and is constant throughout the entire period $t_0$ to $t_5$. However, at $t_5$, the direct current pulse is stopped and no more direct or alternating current is applied to the system anymore. Therefore, no more heat is generated in the fluid anymore after $t_5$. As is shown in FIG. 4B, at $t_5$, the amount of heat generated Q decreases from $Q_{tot}$ to 0.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A method for operating a jetting device, the jetting device being configured to expel droplets of an electrically conducting fluid wherein at least a part of the conductive fluid is positioned in a magnetic field, the method comprising the steps of:

a) providing a direct electrical current in the part of the conductive fluid positioned in the magnetic field, thereby generating a Lorentz force in the conductive fluid and generating an amount of heat;

b) providing an alternating electrical current in the part of the conductive fluid positioned in the magnetic field, the alternating electrical current generating an amount of heat; and c) controlling the direct electrical current and the alternating electrical current such that the sum of heat generated by the direct electrical current and the alternating electrical current is substantially constant.

2. The method according to claim 1, wherein the alternating electrical current is a high frequency alternating current having a frequency in the range of from 100 kHz to 1000 kHz.

3. The method according to claim 1, further comprising the steps of:

providing a first pulse of the direct electrical current, thereby ejecting a first droplet of the electrically conductive fluid and providing a second pulse of the direct electrical current, thereby ejecting a second droplet of the electrically conductive fluid, wherein the magnitude of the current of the first pulse and the second pulse is equal; and in between the first and second pulse of direct electrical current, providing an alternating electrical current in the part of the conductive fluid positioned in the magnetic field.

4. A jetting device for printing a droplet of an electrically conductive fluid, the jetting device comprising:

a fluid chamber for holding an amount of the electrically conductive fluid; and an actuation assembly configured to expel droplets of the electrically conductive fluid from the chamber through a nozzle, the actuation assembly comprising a magnetic field generating unit for generating a magnetic field in at least a part of the fluid chamber; and an electrical direct current generating unit for generating a direct electrical current in the electrically conductive fluid in the part of the chamber provided with the magnetic field, thereby generating a pressure wave in the conductive fluid in said part of the fluid chamber and generating an amount of heat, wherein the jetting device further comprises:

an electrical alternating current generating unit for generating a alternating electrical current in the electrically conductive fluid in the part of the chamber provided with the magnetic field and generating an amount of heat, a control unit configured to in operation control the direct electrical current and the alternating electrical current such that the sum of heat generated by the direct electrical current and the alternating electrical current is substantially constant.

5. The jetting device according to claim 4, wherein the electrical direct current generating unit is operatively connectable to two electrodes in contact with the electrically conductive fluid for providing the electrical direct actuation current in the conductive fluid, the printing device being configured such that the two electrodes are operatively connected to the electrical direct current generating unit upon actuation.

6. The jetting device according to claim 5, wherein the electrical alternating current generating unit is operatively connectable to the two electrodes in contact with the electrically conductive fluid.

* * * * *